United States Patent [19]

Beaussant

[11] 4,172,455

[45] Oct. 30, 1979

[54] BREATHING EQUIPMENT FOR HIGH ALTITUDE FLIGHTS

[75] Inventor: Raymond H. Beaussant, Bretigny, France

[73] Assignee: Intertechnique, Plaisir, France

[21] Appl. No.: 830,199

[22] Filed: Sep. 2, 1977

[30] Foreign Application Priority Data

Dec. 28, 1976 [FR] France ..... 76 39294

[51] Int. Cl.[2] ..... A62B 7/14

[52] U.S. Cl. ..... 128/142.7; 128/142.2

[58] Field of Search ..... 128/142.7, 142.5, 142.4, 128/142.2, 142 R, 141 R, 146.7, 146.3, 204; 2/6, 2.1 R, 2.1 A, 421, 413, 411

[56] References Cited

U.S. PATENT DOCUMENTS

| | | | |
|---|---|---|---|
| 2,335,474 | 11/1943 | Beall | 128/142.5 X |
| 2,970,593 | 2/1961 | Seeler | 128/146.7 |
| 3,433,222 | 3/1969 | Pinto | 128/142.2 |
| 3,438,060 | 4/1969 | Lobelle et al. | 2/6 |
| 3,892,234 | 7/1975 | Jones | 128/142 R |
| 3,910,269 | 10/1975 | Ansite et al. | 128/142.7 X |

*Primary Examiner*—Henry J. Recla

*Attorney, Agent, or Firm*—Lane, Aitken & Ziems

[57] ABSTRACT

A breathing equipment for high altitude flights comprises a breathing mask provided with a breathing gas regulator capable of supplying breathing gas under pressure and a helmet. The helmet is provided with means which, if the pressure of the breathing gas supplied to the mask is higher than the ambient pressure by an amount exceeding a predetermined threshold, subject those organs of the head which are particularly sensitive to the pressure differential to a gas over-pressure sufficient to avoid physiological troubles.

15 Claims, 8 Drawing Figures

Fig.5.
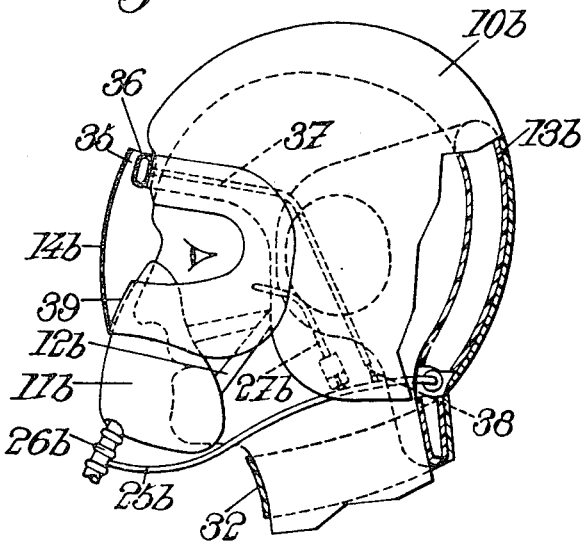
Fig.6.
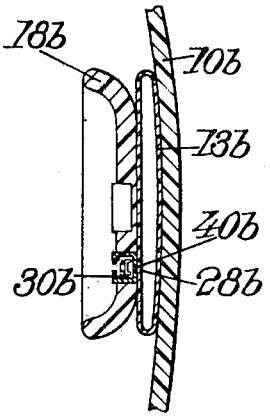
Fig.7.
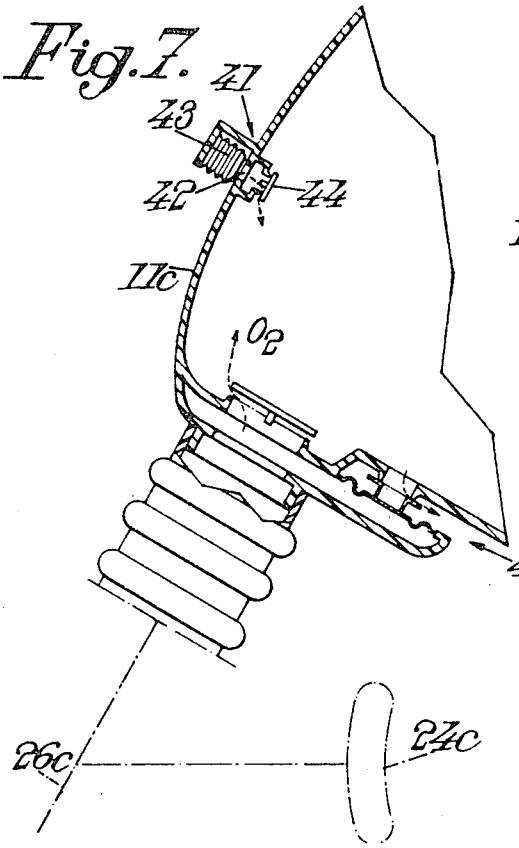
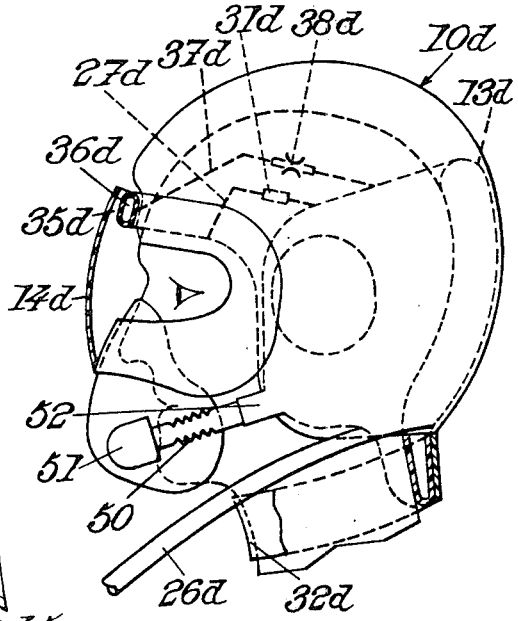
Fig.8.

BREATHING EQUIPMENT FOR HIGH ALTITUDE FLIGHTS

BACKGROUND AND SUMMARY OF THE INVENTION

The invention relates to breathing equipment for high altitude flights, above about 15,000 meters.

In order to protect the crew members of high altitude flying planes against risks of anoxia and air embolism, the following solution is generally adopted in present military aircraft; from about 1,500 meters, there is established in the living space an over-pressure with respect to the surrounding atmosphere, this over-pressure increasing with the altitude to reach 300 millibars at about 5,000 meters and then remaining constant. A breathing gas regulator is provided which supplies individual breathing masks, from an oxygen supply, at first with oxygen diluted with ambient air drawn from the cabin, then with pure oxygen to supply to the personnel a breathing mixture at an acceptable partial oxygen pressure.

In the case of loss of cabin pressure or ejection, the crew members become subjected to the surrounding atmospheric pressure. Equipment must be provided for then modifying the breathing gas supplied to the breathing equipment so as to avoid any loss of consciousness during the time necessary to reach a "safe" altitude (about 9,000 meters) from the highest possible flight altitude.

In the case of flights not exceeding 15,000 meters, it is sufficient to provide a regulator supplying the personnel with pure pressurized oxygen in case of accident. For very high altitude flights, the only sure solution at present consists of using a total pressurisation helmet enclosing the head and the neck of the crew member, associated with a pneumatically pressurised garment. Such equipment provides for a stay at 30,000 meters for periods which do not substantially exceed one hour. But it has numerous disadvantages. The helmet is heavy, all the more so since it must be sufficiently rigid to withstand the internal pressure. It must be strapped to the body of the wearer for resisting the forces due to the pressure which prevails inside it and tends to snatch it away. The eye-piece, being sealingly closed during the whole flight, hinders the pilot.

On the other hand, present non-pressurised helmet equipment, even if better tolerated for normal flights, does not provide a sufficient protection beyond about 15,000 meters. To prevent the personnel from losing consciousness, it is necessary to supply the helmet with oxygen at an over-pressure in relation to the ambient atmosphere, such that it causes serious troubles and particularly: accidents to the internal ear; an oxygen flow via the tear ducts, which disturbs the vision; and swelling of the neck.

It is an object of the invention to provide breathing equipment which protects the wearer against loss of pressurisation of the space in which he lives at high altitudes, for a period of time sufficient for him to regain a safe altitude from the highest flight altitude and does not present the disadvantages of a total pressurisation helmet.

According to an aspect of the invention, there is provided breathing equipment comprising a breathing mask constructed to supply breathing gas under pressure and a helmet provided with means which, responsive to supply of the mask with breathing gas at an over-pressure greater than a threshold, subject only the more sensitive organ(s) of the head to a gas over-pressure not exceeding that which prevails in the mask. The over-pressure(s) may increase from a few millibars up to a value which reaches several tens of millibars at an altitude of 20,000 meters and above.

Such equipment permits the differential oxygen pressures applied to the sensitive organs to be limited to physiologically acceptable values. The values associated with different organs may be different: e.g. a greater differential pressure can be accepted for the eyes than for the ears.

In accordance with a particular feature of the invention, the helmet is provided with ear-pieces tightly applied against the head and defining around each ear a compartment provided with a pipe for bringing gas from the mask supply, comprising flow limiting means, such as a restriction, and a calibrated valve which limits the over-pressure.

According to another optional feature of the invention, the equipment comprises an eye-piece or goggles which, when placed in front of the eyes, define around the eyes a chamber provided with a pipe for bringing the gas from the mask supply, comprising a flow limiting restricted orifice and a calibrated valve which limits the over-pressure.

The calibrated valves may be designed not only to limit the over-pressure, but also to avoid oxygen losses by sealing the system tight in normal conditions of use.

The invention will be better understood after reading the following description of particular embodiments given as non-limiting examples.

SHORT DESCRIPTION OF THE DRAWINGS

Figure 1:
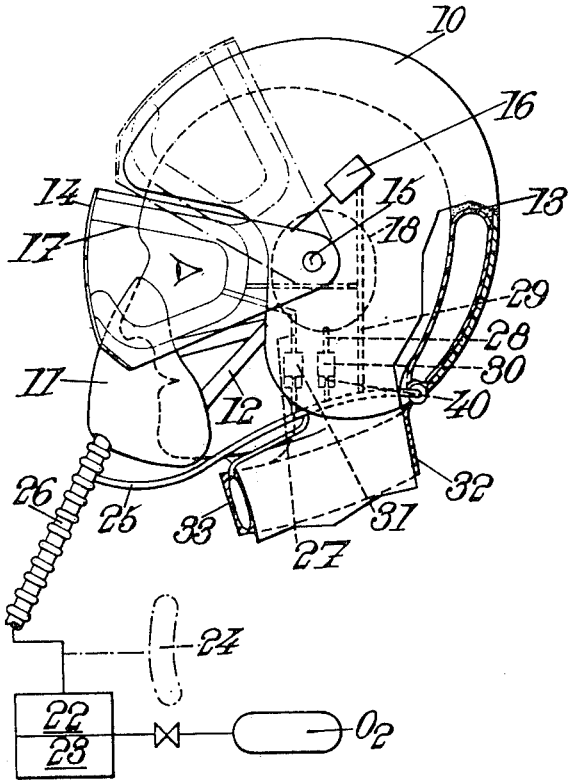
FIG. 1 is a schematic elevational view of an embodiment of the rigid shell helmet.
Figure 4:
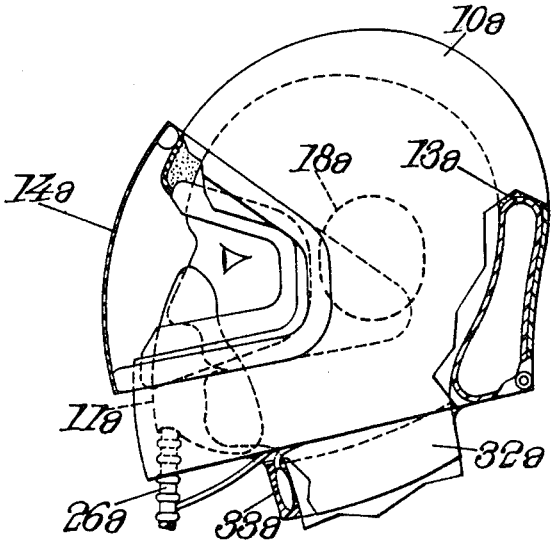

FIG. 4, similar to FIG. 1, shows equipment using an integral helmet;

FIG. 5 is a general diagram of equipment forming a modification of FIG. 1;

FIG. 6 is a cross-sectional diagram showing the relative arrangement of an ear-piece and the pocket of the helmet of FIG. 5; and FIGS. 7 and 8 are general diagrams of other modified embodiments.

DETAILED DESCRIPTION OF PREFERRED EMBODIMENTS

Referring to FIG. 1, there is shown equipment which comprises a rigid helmet 10 and a breathing mask 11 enclosing the nose and the mouth, connected to the helmet by adjustable tension straps 12. The helmet comprises, confronting the occipital part of the head, an inflatable cushion 13 whose presence is not indispensable but which is for balancing the over-pressure which, at altitude, prevails in mask 11 and tends to remove it from the face. This cushion is for example according to one of the embodiments disclosed in U.S. Pat. No. 2,970,593, although other types can also be used.

Helmet 10 is provided with a rigid transparent eye-piece 14 pivotably mounted on the helmet about an axis 15. The normal conditions of use of the mask, this eye-piece is in the raised position in which it is shown in dot-dash lines in FIG. 1. A gas pressure actuator 16 is provided which may lower it to the closed position where it is shown in continuous line in FIG. 1. The eye-piece is provided with inflatable sealing joints 17. At rest, the resilience of the joints maintains them in flattened condition, whereby they do not hinder the pivoting of the eye-piece. When they are inflated, they are applied against the face of the wearer and breathing mask 11 and thus define a chamber around the eyes.

Figure 2:
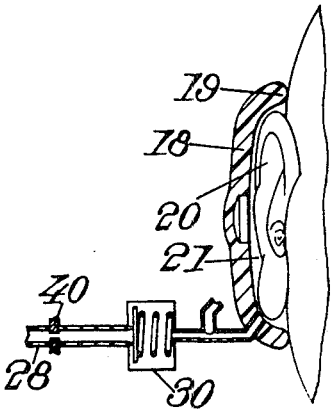
FIG. 2 is a general diagram showing the supply to the ear pieces.

Referring to FIGS. 1 and 2, there are shown two ear-pieces 18 carried by the helmet and located inside it. The ear pieces are provided with ear-phones and present a bulged edge 19 for ensuring a partial seal around each ear 20 thus defining a compartment.

The equipment comprises also a demand regulator 22 for supplying breathing gas to mask 11, as well as a regulator 23 for pressurising partial pressurisation trousers at high altitude and to limit the effects of centrifugal acceleration (anti-g suit). The regulators 22 and 23 and the anti-g trousers, since they can be of conventional design, will not be described here.

The equipment also comprises a device for establishing inside eye-piece 14 and in ear-pieces 18 an over-pressure with respect to the surrounding ambient pressure, when the over-pressure of the breathing gas becomes such that it could cause troubles. In the embodiment illustrated, this device is fed by a derivation 25 from the feed pipe 26 of the mask which divides into three branches 27, 28 and 29. Branch 28, provided with a flow limiting restriction 40 and a calibrated valve 30, is connected to compartments 21 defined by ear-pieces 18. Downstream of calibrated valve 30 branch 28 divides into two lines. There could also be provided two branches 28 each comprising a restriction and a valve.

Outlet 27 is connected to the chamber limited by the eye-piece via a restriction and a calibrated valve 31, whereas outlet 29 feeds the eye-piece closing actuator 16 and inflatable seal 17. A restriction may be provided upstream of seal 17. Such a restriction limits the air flow and delays complete inflation of the seal until the eye-piece is in place. It also limits oxygen loss in case of seal fracture.

Figure 3:
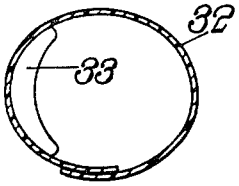
FIG. 3 is a cross-sectional view showing schematically the construction of the pressurisation collar for the neck.

The equipment further comprises means for avoiding swelling of the neck. When the maximum flight altitude envisaged is not too high, these means can be a collar tightly wrapped around the neck. When the altitude is such that this measure is insufficient, the neck is subjected to a controlled pressure adjusted in dependence on the over-pressure which prevails in the mask. Different solutions may be adopted. In the embodiment illustrated in FIGS. 1 and 3, a partial pneumatic pressurisation is used: a pocket 33 carried by a collar 32 secured to the rigid helmet is interposed between the collar and the neck and only develops over part of the angular extent of the collar. The collar may be a strip of non-stretchable material whose length is adjustable, for example by self-adhesive surfaces made of material such as that known under the trademark "VELCRO". The inflatable pocket 33 is typically placed at the front, so as to conform to the glottis of the wearer and to give a less uncomfortable feeling than that of a strip of material tight around the neck. The pocket is supplied directly from the supply for the mask and cushion 13.

The calibration of the valves 30 and 31 is determined depending on physiological data. The following values can be envisaged which are only given by way of example and must be considered as having no limiting character:

valve 30, calibrated for pressure differential of 80 mb., valve 31, calibrated at 90 mb. (the eyes being less sensitive than the ears).

Due to the great length of the line along which the eye-piece contacts the face and due to the difficulty of forming a leak-tight seal on the hair, as well as between the ear-pieces and the head, it is impossible to avoid leaks. On the other hand, the presence of leaks should not disturb the air supply to the mask which is essential. For this purpose, the total flow cross-sectional area offered by all restrictions located at outlets 27, 28 and 29 is given a value which depends on the flow capacities of regulator 22 and is small enough to guarantee that an over-pressure is maintained in the mask and the respiratory tract of the pilot. The restrictions can however have fairly wide dimensions, since at high altitude the difference between the maximum flow which regulator 22 can supply and the flow necessary for the breathing tract is relatively large.

The equipment further comprises a pressurisation jacket provided with an inflatable pocket 24 supplied by regulator 22.

The device operates as follows. Before a high altitude flight, regulator 22 is programmed to supply the pilot with pure oxygen from a relatively low altitude so as to protect him without appreciable delay against the risks of depressurisation of the cabin. Pocket 33, actuator 16 and inflatable joint 17 are permanently fed by regulator 22, as well as chest pocket 24. They are however designed for them not to have an appreciable effect as long as the over-pressure created by the regulator in the mask is for comfort only (2 to 5 mb. for example). Valves 30 and 31 being calibrated for substantial values, they remain closed and separate the protection system from the regulator during normal use.

Should the living space be depressurised at high altitude, the regulator supplies the mask with pure oxygen under a high pressure. Different laws of variation of the over-pressure as a function of altitude are presently adopted in different countries, and the system may be adapted to any one of such laws. It will be assumed, as an example, that, if depressurisation occurs at 15,000 meters, regulator 22 establishes in mask 11 an over-pressure of 90 mb with respect to the environment. Then, actuator 16 lowers eye-piece 14. Joint 17 is inflated but no pressurisation of the eyes appears, since valve 31 remains closed. However, valve 30 opens and an over-pressure of 10 mb with respect to the surrounding atmosphere is created. Pocket 33 is also inflated under the total over-pressure but its action on the neck is reduced because it only acts on a portion of the extent of collar 32. Cushion 13 expands under the action of the differential pressure to which it is subjected and presses mask 11 firmly against the face, thereby suppressing leaks to a large extent.

Should the living space be depressurised at 20,000 meters and assuming an over-pressure of 120 mb in the mask, valves 30 and 31 will adjust the over-pressure at values of 40 mb for the ears and 30 mb for the eyes.

In any case, the limitation of the over-pressure by valves 30 and 31 reduces the stresses supported by the helmet as well as leaks and, consequently, the delivery rate. If the parts fulfilling one of the functions fail or fracture, the corresponding flow restriction 31 or 40 limits the flow so as to reserve for the mask the flow rate necessary for breathing.

Instead of using a helmet with eye-piece, the crew members may be provided with goggles which they must permanently wear during certain types of flights. Then there is no need for an inflatable joint and a lowering actuator. The only remaining requirement is air supply of the space limited by the face and the goggles.

Instead of a simple helmet, the crew members can wear an integral helmet, for instance of the kind illustrated in FIG. 4 (where, for simplicity's sake, the parts corresponding to those already shown in FIG. 1 bear the same reference number to which *a* has been added): the protection collar for the neck may be integrated with the pressurised jacket rather than connected to the helmet. Mask 11*a* is then retained in the helmet.

In the modified embodiment illustrated in FIGS. 5 and 6 (where the parts corresponding to FIG. 1 again bear the same reference number to which *b* has been added), helmet 10*b* is provided with a fixed eye-piece 14*b*. In order to overcome the usual disadvantages of the eye-piece (blur, heat discomfort, . . . ), there is provided a large ventilation slit 35 between the upper part of the eye-piece and the confronting section of the helmet. The ventilation slit is closable by an inflatable seal 36 carried by the helmet and supplied by a derivation 37 from pipe 25*b*. Derivation 37 is again provided with a calibrated restriction 38 for protecting the pilot's breathing oxygen supply should a leak develop in seal 36.

The pressurisation space for the eyes is limited by the eye-piece 14*b* and by a flat sealing joint 39 whose periphery is connected, at its lower part, to eye-piece 14*b* and, at its upper part, to the shell of the helmet. When outlet 27*b* supplies oxygen under pressure to the compartment defined by the eye-piece and joint 39, the internal edge of the flat flexible joint is forcibly applied against the face of the pilot. Sufficient sealing is thus ensured.

The lower section of the joint and of the eye-piece must be designed to avoid excessive downward limitation of the visual field of the crew member, particularly if a pilot. If so designed, the device ensures a satisfactory protection, while remaining very simple in construction and not presenting the usual disadvantages of helmets with a permanently closed eye-piece.

Instead of providing the ventilation by means of a slit between the eye-piece and the helmet, the helmet can be provided with an opening closable by an inflatable pocket which replaces joint 36.

In the embodiment of FIGS. 5 and 6, the occipital pocket 13*b* extends over the nape of the neck of the pilot and projects inside the collar so as to play also the part of pocket 33 in the embodiment of FIG. 1. Moreover, pocket 13*b* extends laterally on each side of the head to cover ear-pieces 18*b* and to press them firmly against the head so as to improve air-tightness. A flow restrictor 40*b* and a calibrated valve 30*b* may then be incorporated in each ear-piece.

In the embodiments which have been described up to now, an oxygen dilution device may be incorporated in regulator 22. Then chest pocket 24 of the inflatable jacket receives initially a mixture of air and oxygen which is only progressively replaced by pure oxygen at altitude. In order to ensure an immediate protection for the pilot should the living space suffer decompression, without however having to supply him with pure oxygen from take-off, the embodiment shown in FIG. 7 may be used: pipe 26*c* coming from the regulator then supplies pure oxygen to mask 11*c* and to pocket 24*c* and the mask carries a dilution system 41 formed by an air inlet comprising, placed in series relation, an aperture 43 closed at high altitude by an altimetric capsule 43 and a non-return valve 44 avoiding oxygen leaks when the mask is fed under a pressure higher than the surrounding pressure. The mask carries moreover an expiration valve 45 (not shown in FIGS. 1, 4 and 5) which can be conventional.

The masks illustrated in FIGS. 1, 4, 5 and 7 are provided with a conventional "elephant trunk" oxygen supply hose which contributes to pilot fatigue and impairs downward vision. In the embodiment of FIG. 8, the helmet is for use with an oxygen supply system in which the breathing gas is delivered by a flexible piping connected to the helmet and a breathing gas supply hose connects the helmet and the side of the mask. A description of a system of that type may be found in "SAFE JOURNAL", Spring Quarter, 1974, pages 22 et seq.

In FIG. 8 (where the elements corresponding to those in FIG. 5 are identified with the same reference numerals with a "*d*" added thereto) the breathing gas supply piping 26*d* is connected to helmet 10*d* and opens into pocket 13*d*. A flexible supply hose 50 is permanently connected to a unit 51 carried by the mask and incorporating an inspiratory valve and a compensated expiratory valve (not shown). The end portion of hose 50 is sealingly connected to a female connector 52 carried by the helmet. A line 37*d* provided with a restriction 38*d* and a line 27*d* provided with a calibrated valve 31*d*, similar to the corresponding lines in the embodiment of FIG. 5, supply inflatable seal 36*d* and eye piece 14*d*, respectively, from pocket 13*d*. Again, an inflatable collar 32*d* carried by the helmet may be provided.

Since in that embodiment the supply piping is connected to the lower portion of the helmet close to the rear of the helmet, the tractive force of the piping is applied close to the axis of rotation of the head and consequently interfers with the movements of the pilot to a much lesser extent than in the conventional arrangements. The mask may be mechanically connected to the helmet by any prior art type of connecting device or harness designed for offering a possibility of adjustment.

While some embodiments of the invention have been described in detail, it should be understood that various changes and modifications may be made without departing from the invention. It should particularly be kept in mind that a number of different types of head gear different from the helmets which have been described for explanatory purposes may be used.

I claim:

1. Breathing equipment for an aircraft crew member comprising a breathing mask adapted to cover the wearer's nose and mouth, means for delivering breathing gas under variable pressure with respect to ambient pressure to said mask upon demand of the wearer, a rigid head gear, ear pieces defining a compartment adapted to enclose each ear of the wearer mounted on each side of said head gear, and means operatively associated with said mask and said head gear for delivering said breathing gas under variable pressure from within said mask to said earpieces at a calibrated flow rate which includes means sensitive to said variable pressure and adapted to establish a gas overpressure in said ear pieces whenever said variable pressure exceeds the ambient pressure by an amount exceeding a predetermined threshold, said overpressure not exceeding the difference between the pressure of the gas delivered to said mask and the ambient pressure.

2. Breathing equipment according to claim 1, further comprising transparent means adapted to define a closed space around the eyes of the wearer, wherein said means associated with said mask and said head gear includes calibrated valve means for maintaining an overpressure in the ear pieces and closed space around the eyes.

3. Breathing equipment according to claim 2, wherein said ear pieces are arranged to define a compartment around each ear of the wearer and said means associated with said mask and head gear include pipe means provided with said calibrated valve means for delivering gas to each said compartment from the mask supply.

4. Breathing equipment according to claim 3, wherein said pipe means comprise flow restriction means.

5. Breathing equipment according to claim 1, further comprising means arranged to encircle the neck of the wearer, said means associated with said mask and said head gear being adapted to maintain an overpressure in the encircling means to exert a pneumatic overpressure on the neck whenever said variable pressure exceeds the ambient pressure by an amount exceeding a predetermined threshold.

6. Breathing equipment according to claim 1, further comprising an eye piece arranged to cooperate with the wearer's face to define around the wearer's eyes a chamber and wherein said means associated with the mask and head gear includes means for supplying breathing gas to said chamber from the mask supply.

7. Breathing equipment according to claim 6, wherein said eye piece is pivotably mounted on the head gear, said equipment further comprising inflatable sealing joints mounted on the eye piece for cooperation with the head gear and wearer's face, and means for automatically closing the eye piece over the eyes and supplying breathing gas to said inflatable sealing joints in response to the appearance of said over-pressure.

8. Breathing equipment according to claim 6, wherein the head gear is in the form of a helmet provided with a fixed eye piece and wherein said helmet and eye piece define ventilation passages, said equipment further comprising inflatable sealing joints which inflate to close the passages in response to the appearance of said over-pressure.

9. Breathing equipment according to claim 1, further comprising a pressurization collar arranged to encircle the neck of the wearer, said collar having a strip of flexible non stretchable material positioned to surround the neck of the wearer, an inflatable pocket affixed to said strip and disposed between said strip and the neck of the wearer, and pipe means for supplying gas to said inflatable pocket from the mask supply.

10. Breathing equipment according to claim 9, wherein said collar is affixed to a pressurized garmet for said wearer and is operatively associated with means for delivering gas from said garmet to said pocket.

11. Breathing equipment according to claim 9, wherein the inflatable pocket is arranged to extend over only a portion of the periphery of the wearer's neck.

12. Breathing equipment according to claim 11, wherein said pocket is arranged to be disposed against the nape of the wearer and constitutes an extension of a pocket carried by the head gear in the form of an helmet between the rigid shell of the helmet and the occipital part of the head.

13. Breathing equipment according to claim 11, wherein said pocket is carried by the helmet and extends between the shell of the helmet and said ear pieces to firmly apply the ear pieces against the wearer's head and to limit leaks when an over-pressure prevails in the ear pieces and in the pocket.

14. Breathing equipment according to claim 1, further comprising a pressurized garmet, wherein the means for delivering breathing gas to said mask include an oxygen source, an oxygen regulator connected to receive oxygen from said source and an oxygen dilution system, said pressurized garmet being connected to said delivering means to receive oxygen from said regulator without dilution.

15. Breathing equipment for high altitude flights, comprising:

a rigid helmet arranged to be carried by a wearer, a breathing mask arranged to be carried by the wearer in position to cover the wearer's nose and mouth, a connecting harness connecting the mask to the helmet, a breathing gas regulator operatively associated with the mask for supplying breathing gas to the mask upon demand of the wearer at a pressure in excess to the pressure of the ambient atmosphere, ear enclosing means mounted on the inside side of said helmet in position to enclose the ears of the wearer, transparent means mounted on said helmet and adapted to define a closed space around the eyes of the wearer, and means associated with the helmet and responsive to said excess pressure which, when said excess pressure exceeds a predetermined threshold, establishes in at least one of said ear enclosing means and closed space around the eyes a partial over-pressure whose value is variable in a range extending from several millibars to the excess pressure which prevails in the mask.

* * * * *